US008002673B2

(12) United States Patent
McVan

(10) Patent No.: US 8,002,673 B2
(45) Date of Patent: Aug. 23, 2011

(54) HAND, WRIST AND FOREARM EXERCISE DEVICE

(75) Inventor: Jesse McVan, Wellington, FL (US)

(73) Assignee: Perfect Pecs, LLC, Wellington, FL (US)

( * ) Notice: Subject to any disclaimer, the term of this patent is extended or adjusted under 35 U.S.C. 154(b) by 0 days.

(21) Appl. No.: 12/800,711

(22) Filed: May 19, 2010

(65) Prior Publication Data

US 2010/0298100 A1 Nov. 25, 2010

Related U.S. Application Data

(60) Provisional application No. 61/216,645, filed on May 19, 2009.

(51) Int. Cl.
*A63B 23/14* (2006.01)

(52) U.S. Cl. ..... 482/46; 482/45

(58) Field of Classification Search ..... 482/44–50, 482/121, 124, 137
See application file for complete search history.

(56) References Cited

U.S. PATENT DOCUMENTS

| | | | | |
|---|---|---|---|---|
| 505,745 | A * | 9/1893 | Barclay | 482/49 |
| 3,542,363 | A * | 11/1970 | Smith et al. | 482/49 |
| 5,312,308 | A * | 5/1994 | Hamilton et al. | 482/44 |
| 6,086,516 | A * | 7/2000 | Santos | 482/5 |
| 6,196,956 | B1 * | 3/2001 | Brown | 482/137 |
| 2005/0037897 | A1 * | 2/2005 | Chen | 482/44 |
| 2008/0318734 | A1 * | 12/2008 | Parnell | 482/44 |

* cited by examiner

*Primary Examiner* — Fenn C Mathew
(74) *Attorney, Agent, or Firm* — Robert M. Downey, P.A.

(57) ABSTRACT

An exercise device for strengthening the hands, wrists and forearms includes a main body providing a hand grip and an arm member linked to one end of the main body by a ball joint assembly to allow pivoting movement of the hand grip relative to the arm member. A selectively adjustable drag assembly imparts a variable controlled force of resistance to the rotational movement of the hand grip about a central longitudinal axis. The exterior of the main body is formed of a resilient rubber material, such as a spongy foam rubber, and is textured to include segmented ribs to simulate a hand grenade shell. A flexible strap with a releasable fastening mechanism attaches between a distal end of the arm member and the user's wrist to effectively anchor the arm member to the user. While grasping the main body, the user turns his/her hand forwards and backwards in a rotating motion against the resistance of the drag assembly.

4 Claims, 3 Drawing Sheets

HAND, WRIST AND FOREARM EXERCISE DEVICE

This application is based on provisional patent application Ser. No. 61/216,645 filed on May 19, 2009.

BACKGROUND OF THE INVENTION

1. Field of the Invention

This invention relates to an exercise device and, more particularly, to a device for strengthening the hands, wrists and forearms and including a grip portion that rotates against a force of resistance relative to a fixed portion that anchors to the user's wrist or arm.

2. Discussion of the Related Art

Various exercises for strengthening the hands, wrists and forearms are well known in the field of physical fitness. Most notably, the use of dumbbells in a wrist curling exercise has been known for many years. This exercise involves placing the forearm on a flat surface, such as a cushioned bench and, with the palm of the hand facing up, a dumbbell of appropriate weight is rolled from the palm to the fingers as the wrist is cocked downwardly. When the dumbbell reaches the fingers, the wrist is cocked upwardly to cause the dumbbell to roll back onto the palm of the hand. This action is repeated several times with each hand.

Another well known exercise for the wrists and forearms involves the use of a cylindrical handle having a length of rope extending from the center between opposite ends of the handle. The bottom end of the rope is tied to a weight. With one hand on each side of the center of the handle and the forearms extending horizontally, the handle is rotated by turning the wrists while alternately grasping and releasing the handle with each hand. This causes the rope to be wound onto the handle as the weight is lifted upwardly toward the handle. When the weight reaches the top, just below the handle, the handle is then rotated in the opposite direction by turning the wrists while alternately grasping and releasing the handle with each hand.

While the above described exercises and devices can be very effective for strengthening the hands, wrists and forearms, the use of weights presents the threat of injury. In particular, use of too much weight can cause muscle and tendon strain, as well as cramping. Dropping the weights causes a further threat of injury to the feet. Moreover, the use of weights makes it extremely inconvenient to carry these exercise devices when traveling.

Accordingly, there remains a need for a highly effective exercise device for strengthening the hands, wrists, and forearms, and wherein the device is relatively lightweight, compact and easy to use without presenting a threat of injury.

SUMMARY OF THE INVENTION

The present invention is directed to an exercise device for strengthening the hands, wrists and forearms. The exercise device is specifically formed and shaped to resemble a hand grenade. The device includes a main body providing a hand grip and an arm member linked to one end of the main body by a ball joint assembly to allow pivoting movement of the hand grip relative to the arm member. A selectively adjustable drag assembly imparts a variable controlled force of resistance to the rotational movement of the hand grip. The exterior of the main body is formed of a resilient rubber material, such as a spongy foam rubber, and is textured to include segmented ribs to simulate a hand grenade shell. The arm member is formed of a rigid material and extends over the length of the main body, in spaced relation thereto. A flexible strap with a releasable fastening mechanism attaches between a distal end of the arm member and the user's wrist to effectively anchor the arm member to the user. While grasping the main body, the user turns his/her hand forwards and backwards in a rotating motion against the resistance of the drag assembly.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the exercise device is shown and is generally indicated as 10 throughout.

As seen in FIGS. 1-4, the exercise device 10 includes a main body 12 shaped, dimensioned and configured to generally resemble the body of a hand grenade. The main body 12 of the device 10 includes a hand grip 14, wherein the four fingers of either the left or right hand are wrapped over one side of the grip 14 and the thumb is wrapped on the opposite side of the grip 14. In a preferred embodiment, the exterior of the grip 14 is made of a resilient rubber material that is comfortable to hold and can be slightly compressed when grasped and squeezed. More particularly, the grip 14 is preferably formed of a spongy rubber material that provides an excellent non-slip grip which is also yieldable to a squeezing force so that the grip can be slightly compressed. The exterior surface of the grip 14 is textured to include segmented ribs forming square, rectangular and/or trapezoidal protruding portions to simulate the outer shell of a hand grenade. The protruding rib segments also function to enhance the user's grasp.

Figure 1:
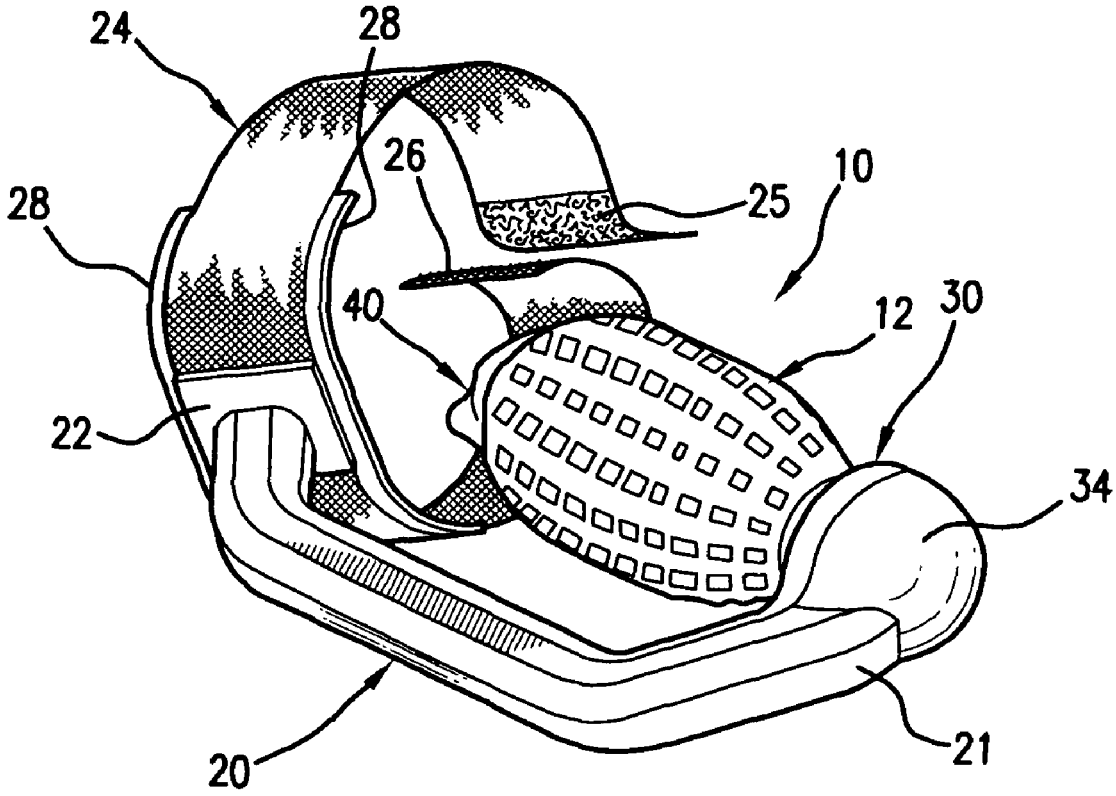
FIG. 1 is a perspective view of the exercise device of the present invention, in accordance with one embodiment thereof.
Figure 2:
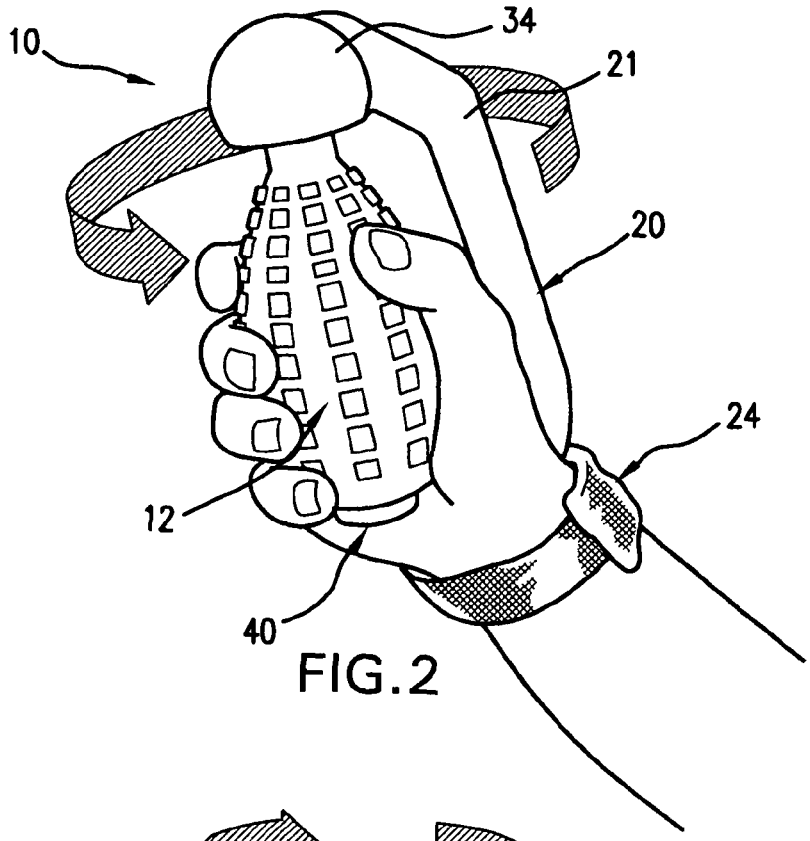
FIGS. 2 and 3 show the exercise device in the hand of a user and demonstrate a sequence of rotational movement of the user's hand and a grip portion of the device between a first position shown in FIG. 2 and a second position shown in FIG. 3.
Figure 3:
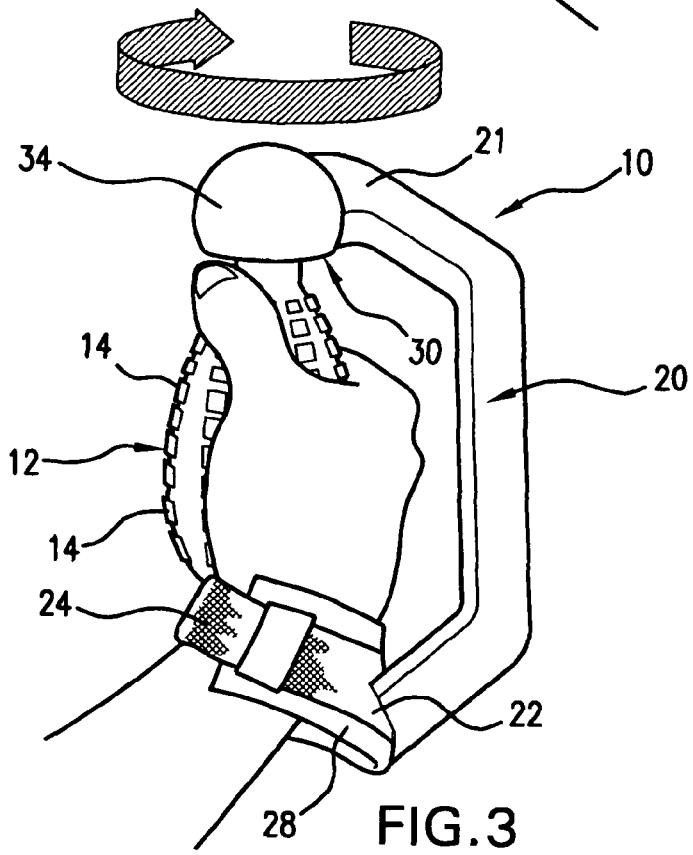
Figure 4:
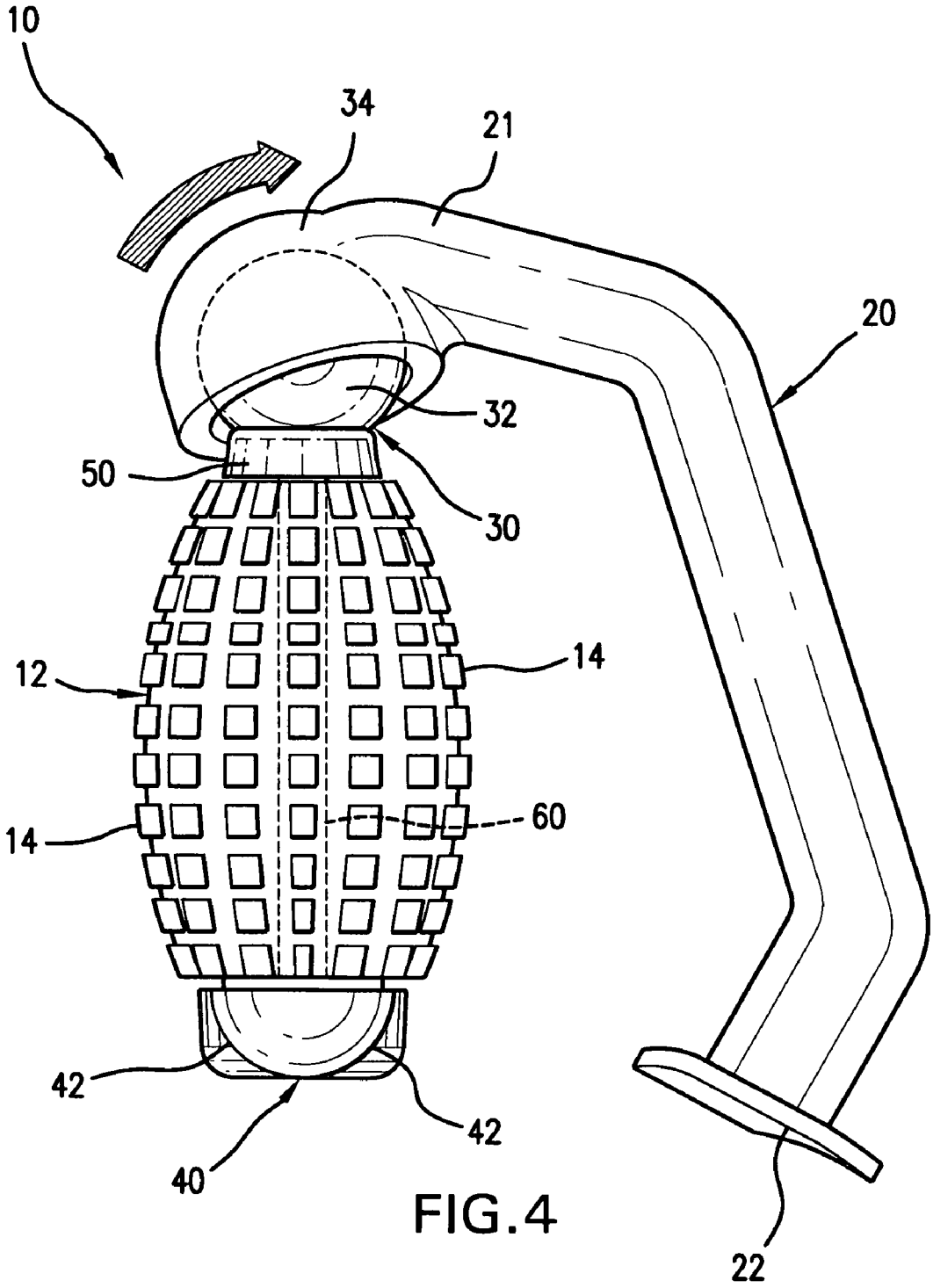
FIG. 4 is a side elevational view of the exercise device of FIG. 3.

A rigid arm member 20 is linked to one end of the main body 12 with a ball joint assembly 30 in a manner that allows pivoting movement of the main body 12 relative to the arm member 20. Specifically, a top end 21 of the arm member 20 has a socket 34 integrally formed with the arm member. A socket cavity captivates a ball 32 that is fitted to end 50 of the main body 12. The ball 32 is moveable within the socket 34 to allow pivoting movement of the main body relative to the arm member 20. The arm member 20 is formed and configured to extend upwardly and over the knuckles of a hand grasping the main body, as seen in FIGS. 2 and 3. The distal end 22 of the arm member 20 is fitted with a strap 24 that extends therefrom for releasable attachment about the user's wrist. The strap 24 may include a rigid or semi-rigid brace 28 that fits against the wrist to provide rigidity, strength and stability where the arm member 20 attaches to the strap 24. Hook and loop fasteners 25, 26 on the ends of opposite segments of the strap 24 allow for adjustable fit of the strap 24 around the wrist of the user. When attached to the wrist, the arm member 20 of the device 10 is anchored and is prevented from moving while rotating the grip 14 using the turning action of the hand. More specifically, with the arm member 20 anchored and fixed in position, the user rotates the hand forward and backwards by cocking the wrist to effectively turn the grip 14 of the device 10 through a partial rotation relative to the arm member 20.

A drag assembly provides resistance against rotation of the main body 12 in either of the select forward and/or rearward directions. In one embodiment, the grip 14 rotates about a central longitudinal axis extending between opposite ends of the grip. The central longitudinal axis may be defined by a post 60 that extends through the grip 14 from the cap 50 at one end to an adjustment knob 40 on an opposite end. The knob 40 is threadably engaged on an end of the post 60 to allow tightening which increases friction of the knob 40 and cap 50 against the opposite ends of the grip 14, thereby defining the drag assembly. Specifically, tightening the knob 40 causes the knob and cap 50 to press against the ends of the grip 14 which serves to increase the amount of resistance when rotating the grip about the central longitudinal axis. The force of resistance to rotational movement of the hand grip 14 can be selectively controlled by tightening or loosening the knob 40. To assist twisting movement of the knob, in order to tighten or loosen, the knob 40 has opposite wing portions 42 that can be easily grasped by the user's fingers.

In a further embodiment, the drag assembly may be defined by a controlled friction including a mechanism in the ball joint 30 that allows for selectively varying the amount of friction between the ball 32 and the socket 34. This will allow for variable controlled resistance against both rotation and pivotal movement of the ball 32 and hand grip 14 relative to the socket 34 and arm member 20 when performing exercise movements, as shown in FIGS. 2 and 3.

Further embodiments of the invention contemplate forming the handle as a one piece rigid structure that partially wraps about the wrist. In this instance, a strap may be used to complete the wrapped attachment around the wrist. Alternatively, the rigid handle may be shaped to provide sufficient engagement on the wrist so that no strap is necessary to effectively anchor the handle relative to the user's wrist and/or forearm.

While the present invention has been shown and described in accordance with several preferred and practical embodiments thereof, it is recognized that departures from the instant disclosure are contemplated within the spirit and scope of the present invention, which is not to be limited, except as defined in the following claims as interpreted under the Doctrine of Equivalents.

What is claimed is:

1. An exercise device for strengthening the hands, wrists and forearms, said exercise device comprising:

a main body including a hand grip portion formed of a resilient material;

an arm member having a proximal end and an opposite distal end;

a wrist strap fitted to said distal end of said arm member for releasable attachment about a user's wrist in order to anchor the arm member to the user's wrist;

a ball joint assembly pivotally linking said main body to said arm member and including a ball member fitted to an end of said main body and a socket on said proximal end of said arm member structured and disposed for captivating said ball member while allowing pivotal, multi-directional movement of said ball member and said main body relative to said socket and said arm member; and a selectively adjustable drag assembly for imparting a variably controlled force of resistance to rotational movement of said hand grip about a central longitudinal axis.

2. The exercise device as recited in claim 1 wherein said drag assembly is structured and disposed to exert friction for imparting the variable controlled force of resistance.

3. The exercise device as recited in claim 2 wherein said drag assembly is structured and disposed to exert friction between said hand grip and at least a portion of said main body for imparting the variable controlled force of resistance.

4. The exercise device as recited in claim 3 wherein said drag assembly includes a control for selectively adjusting the amount of friction exerted between said grip member and said at least a portion of said main body.

* * * * *